US007806650B2

(12) United States Patent
Heyward et al.

(10) Patent No.: US 7,806,650 B2
(45) Date of Patent: Oct. 5, 2010

(54) METHOD AND APPARATUS FOR FABRICATING A NOZZLE SEGMENT FOR USE WITH TURBINE ENGINES

(75) Inventors: John P. Heyward, Loveland, OH (US); Joseph M. Guentert, Cincinnati, OH (US); Todd S. Heffron, Harrison, OH (US)

(73) Assignee: General Electric Company, Schenectady, NY (US)

( * ) Notice: Subject to any disclaimer, the term of this patent is extended or adjusted under 35 U.S.C. 154(b) by 972 days.

(21) Appl. No.: 11/511,963

(22) Filed: Aug. 29, 2006

(65) Prior Publication Data

US 2008/0056907 A1 Mar. 6, 2008

(51) Int. Cl.
*F01D 9/02* (2006.01)

(52) U.S. Cl. ..... 415/115; 415/191

(58) Field of Classification Search ..... 415/115, 415/159, 191, 208.1; 416/97 A, 97 R
See application file for complete search history.

(56) References Cited

U.S. PATENT DOCUMENTS 3,800,864 A * 4/1974 Hauser et al. ..... 165/47
4,232,527 A 11/1980 Reider
4,946,346 A * 8/1990 Ito ..... 415/115
6,173,491 B1 * 1/2001 Goodwater et al. ..... 29/889.1
6,183,192 B1 2/2001 Tressler et al.
6,227,798 B1 5/2001 Demers et al.
6,402,471 B1 6/2002 Demers et al.
6,422,819 B1 7/2002 Tsai et al.
6,769,865 B2 8/2004 Kress et al.
6,793,457 B2 9/2004 Caddell et al.
6,830,427 B2 * 12/2004 Lafarge et al. ..... 415/115
6,905,308 B2 6/2005 Hagle et al.
6,945,750 B2 * 9/2005 Benedetti et al. ..... 415/115
7,008,178 B2 3/2006 Busch et al.
7,121,793 B2 10/2006 Correia

* cited by examiner

*Primary Examiner*—Edward Look
*Assistant Examiner*—Nathaniel Wiehe
(74) *Attorney, Agent, or Firm*—William Scott Andes, Esq.; Armstrong Teasdale LLP

(57) ABSTRACT

A method for orienting cooling holes of a nozzle singlet for a turbine engine is provided. The method includes providing a nozzle singlet having an inner band, an outer band, and at least one airfoil extending therebetween. The method also includes orienting at least one first row of cooling holes an angle with respect to at least one second row of cooling holes. The orientation of the at least one first row and the at least one second row provides a cooling hole pattern that accommodates a change in the airfoil angle without reorienting the cooling hole pattern.

20 Claims, 6 Drawing Sheets

METHOD AND APPARATUS FOR FABRICATING A NOZZLE SEGMENT FOR USE WITH TURBINE ENGINES

BACKGROUND OF THE INVENTION

This invention relates generally to turbine engines and, more particularly, to methods and apparatus for fabricating a nozzle singlet for use with turbine engines.

At least some known turbine engines include turbine nozzle assemblies having a plurality of nozzle singlets that extend circumferentially around the turbine. The nozzle singlets are positioned throughout various stages of the turbine to facilitate channeling air downstream towards turbine blades. Specifically, adjacent nozzle singlets are circumferentially spaced and oriented to define a throat through which hot gases are channeled. An area of the throat may vary between different known engines or within different areas of an engine as the area of the throat is a factor that contributes to determining a mass flow of hot gas exiting the throat. The throat area is proportional to the throat width. As such the throat width can be adjusted to control a ratio of mass flow entering the throat to mass flow exiting the throat.

Known nozzle singlets are typically fabricated from two machined singlets. These singlets are cast from a unitary piece to include an inner band, an outer band, and at least one airfoil extending therebetween. Cooling holes are then machined into the nozzle singlet to facilitate cooling during engine operations. Generally, the cooling holes are machined in a pattern that is identical for each nozzle singlet machined. Following assembly of the nozzle singlets to create the nozzle singlet, the inner and outer bands of the nozzle singlet are then reshaped through grinding and/or machining to position the airfoil to provide a desired throat width when the engine is assembled. Specifically, the inner and outer bands are fabricated to be positioned substantially flush with a circumferentially-adjacent nozzle singlet to provide the desired airfoil angle. Because the throat width, and subsequently, the airfoil angle, may differ from engine to engine, the inner and outer bands may be machined at different angles. However, machining the bands to accommodate at least some desired airfoil angles may result in a need to adjust the cooling hole pattern to avoid having the cooling holes obliterated during machining.

BRIEF DESCRIPTION OF THE INVENTION

In one aspect, a method for orienting cooling holes of a nozzle singlet for a turbine engine is provided. The method includes providing a nozzle singlet having an inner band, an outer band, and at least one airfoil extending therebetween. The method also includes orienting at least one first row of cooling holes an angle with respect to at least one second row of cooling holes. The orientation of the at least one first row and the at least one second row provides a cooling hole pattern that accommodates a change in the airfoil angle without reorienting the cooling hole pattern.

In another aspect, a nozzle singlet for a turbine engine is provided. The nozzle singlet includes an inner band, an outer band, and at least one airfoil extending therebetween. The nozzle singlet also includes at least one first row of cooling holes oriented an angle with respect to at least one second row of cooling holes. The orientation of the at least one first row and the at least one second row provides a cooling hole pattern that accommodates a change in the airfoil angle without reorienting the cooling hole pattern.

In a further aspect, a turbine engine is provided. The turbine engine includes a turbine nozzle assembly including a plurality of nozzle singlets. Each nozzle singlet includes an inner band, an outer band, and at least one airfoil extending therebetween. Each nozzle singlet also includes at least one first row of cooling holes oriented an angle with respect to at least one second row of cooling holes. The orientation of the at least one first row and the at least one second row provides a cooling hole pattern that accommodates a change in the airfoil angle without reorienting the cooling hole pattern.

DETAILED DESCRIPTION OF THE INVENTION

Although the below-described apparatus and method are described in terms of singlets, the present invention is not limited to singlets, but rather, may also apply to doublets and/or any other nozzle segments.

Figure 1:
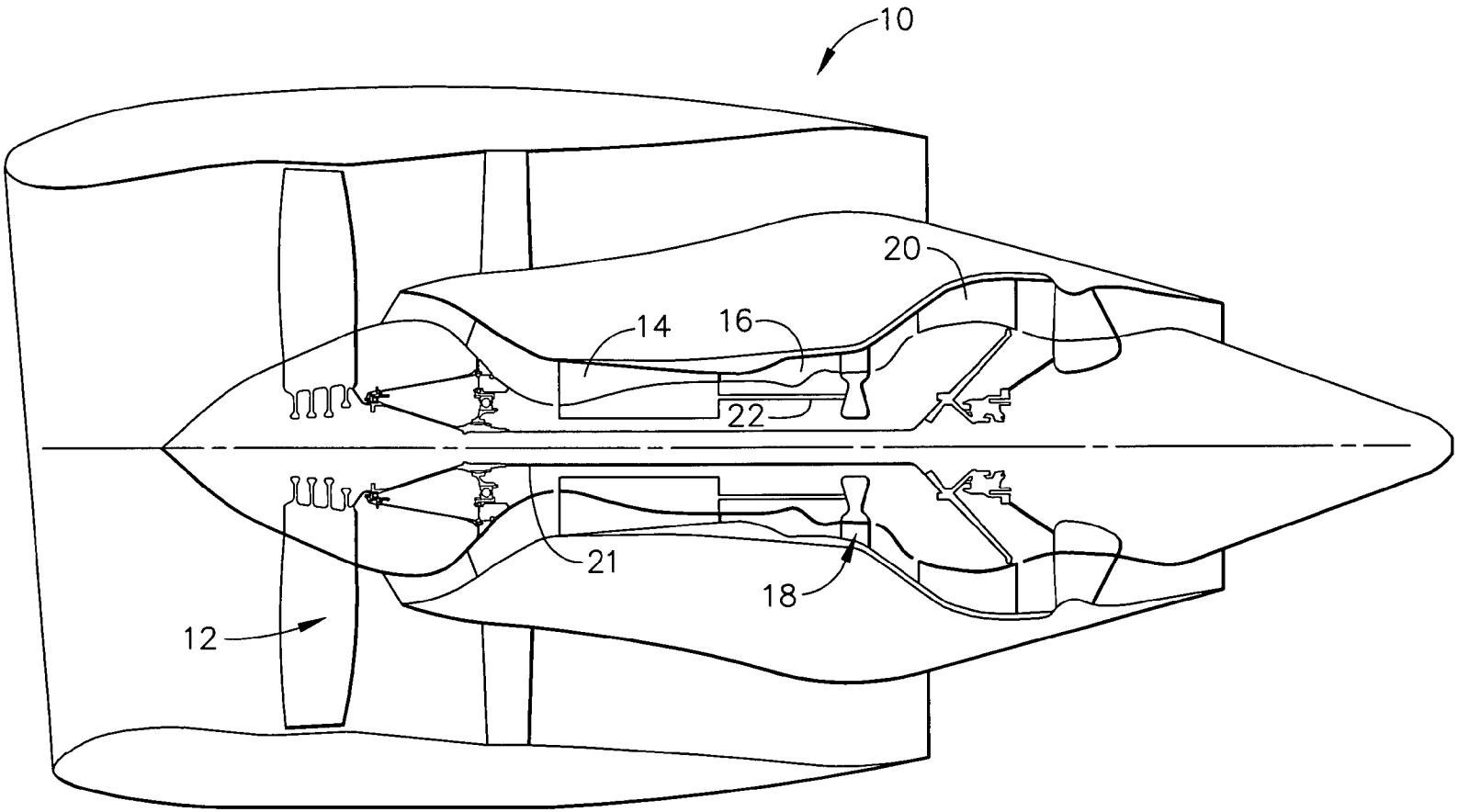
FIG. 1 is a schematic illustration of an exemplary gas turbine engine.

FIG. 1 is a schematic illustration of an exemplary gas turbine engine 10. Engine 10 includes a low pressure compressor 12, a high pressure compressor 14, and a combustor assembly 16. Engine 10 also includes a high pressure turbine 18, and a low pressure turbine 20 arranged in a serial, axial flow relationship. Compressor 12 and turbine 20 are coupled by a first shaft 21, and compressor 14 and turbine 18 are coupled by a second shaft 22.

Figure 2:
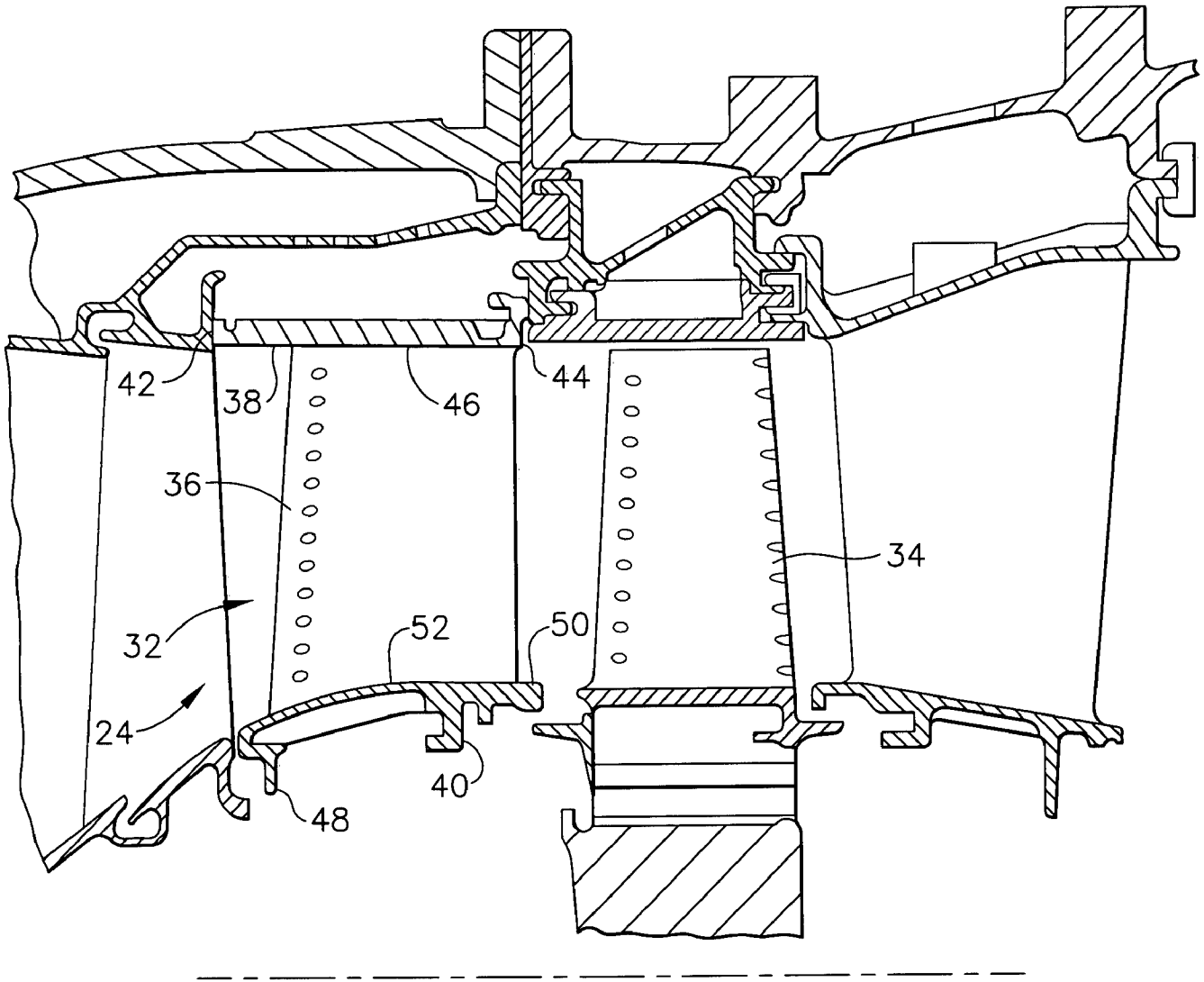
FIG. 2 is an enlarged cross-sectional view of a turbine nozzle assembly that may be used with the gas turbine engine shown in FIG. 1.

FIG. 2 is an enlarged cross-sectional view of a turbine nozzle assembly 24 that may be used with gas turbine engine 10. In one embodiment, a plurality of turbine nozzle singlets 32 are circumferentially abutted together to form turbine nozzle assembly 24. In this embodiment, each nozzle singlet 32 includes an outer band 38 and an opposing inner band 40 integrally-formed with an airfoil vane 36. As such, in the exemplary embodiment, nozzle assembly 24 includes a plurality of circumferentially-spaced airfoil vanes 36 that are coupled together by a radially outer band or platform 38, and an opposing radially inner band or platform 40.

Outer band 38 includes a leading or upstream face 42, a trailing or downstream face 44 and a radially inner surface 46 that extends therebetween. Inner band 40 also includes a leading or upstream face 48, a trailing or downstream face 50 and a radially inner surface 52 that extends therebetween. Inner surfaces 46 and 52 define a flow path for combustion gases to flow through turbine nozzle assembly 24. In one embodiment, the combustion gases are channeled through nozzle assembly 24 towards a downstream turbine, such as high pressure turbine 18 and/or low pressure turbine 20. More specifically, combustion gases are channeled between turbine nozzle singlets 32 towards turbine rotor blades 34 which drive high pressure turbine 18 and/or low pressure turbine 20.

Figure 3:
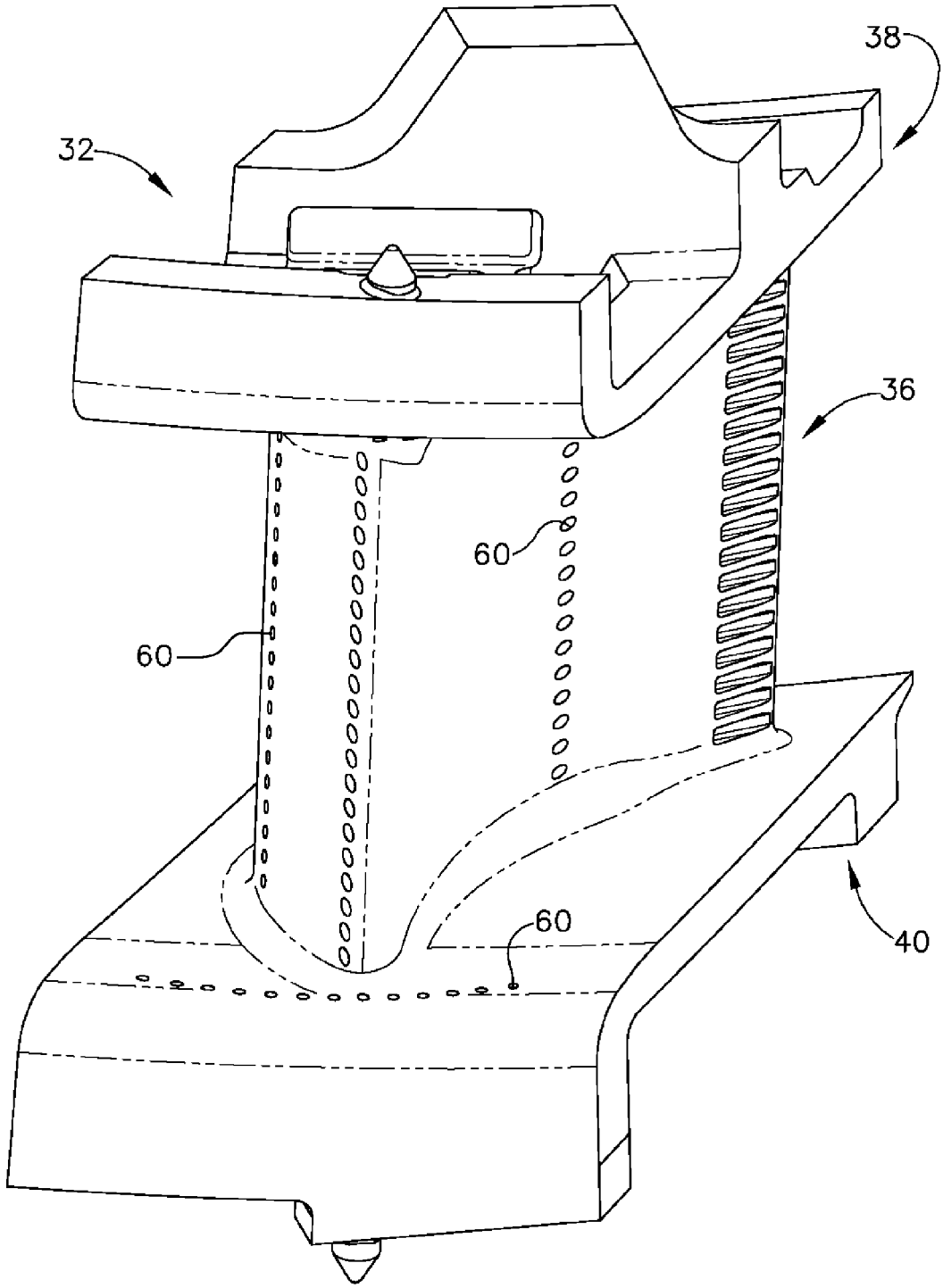
FIG. 3 is a perspective view of a nozzle singlet that may be used with the turbine nozzle assembly shown in FIG. 2.

FIG. 3 is a perspective view of a nozzle singlet 32 that may be used with turbine nozzle assembly 24. In the exemplary embodiment, nozzle singlet 32 includes one airfoil vane 36 extending between outer band 38 and inner band 40. Airfoil vane 36, inner band 40, and outer band 38 each include a plurality of cooling holes 60 that facilitate cooling nozzle singlet 32 during engine operation.

Figure 4:
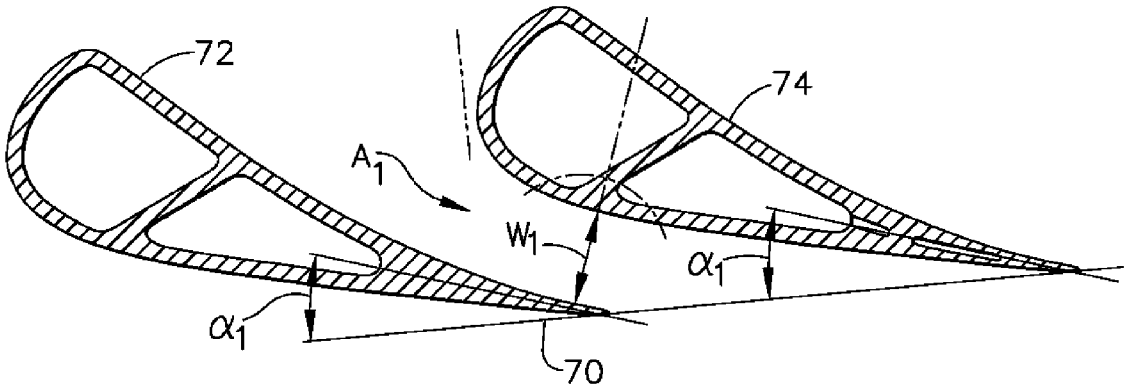
FIG. 4 is a top schematic view of two airfoil vanes that may be used with the turbine nozzle assembly shown in FIG. 2.

FIG. 4 is a top schematic view of two airfoil vanes 36 that may be used with nozzle assembly 24. The airfoil vanes 36 are each oriented at an angle with respect to an aft end 70 of nozzle singlet 32 to define a throat area $A_1$. Specifically, a first airfoil 72 and a second airfoil 74 are each oriented at an angle $\alpha_1$. By adjusting angle $\alpha_1$, a throat width $W_1$ can be increased or decreased, thereby increasing or decreasing a throat area $A_1$. Specifically, increasing throat area $A_1$ facilitates increasing the mass flow of air channeled between airfoils 72 and 74, and decreasing throat area $A_1$ facilitates decreasing the mass flow of air channeled between airfoils 72 and 74.

Figure 5:
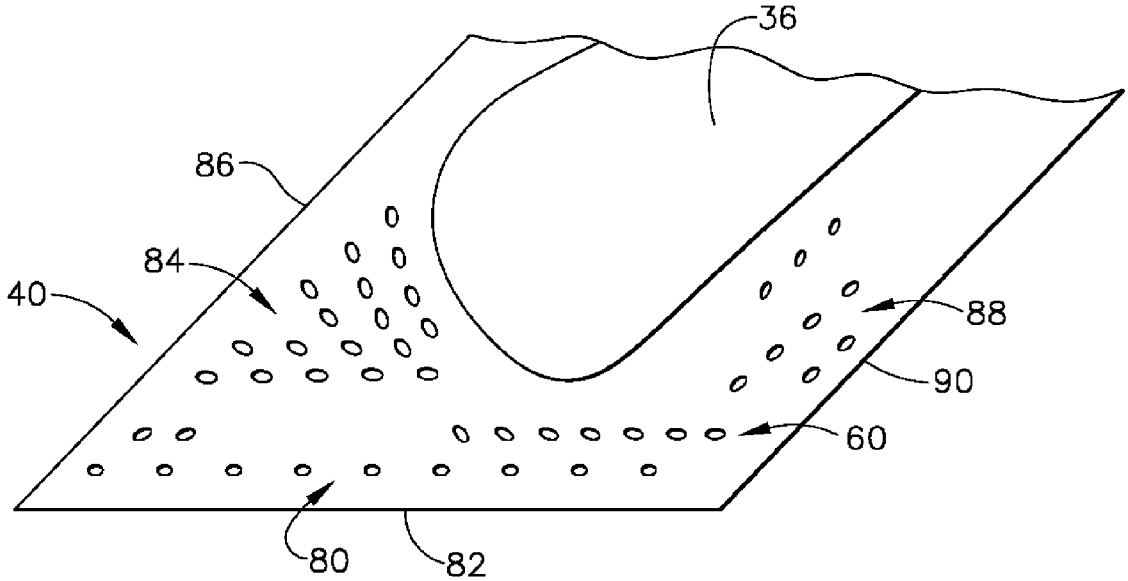
FIG. 5 (PRIOR ART)
FIGS. 5-7 are top schematic views of a known inner band that may be used with the nozzle singlet shown in FIG. 3.
Figure 6:
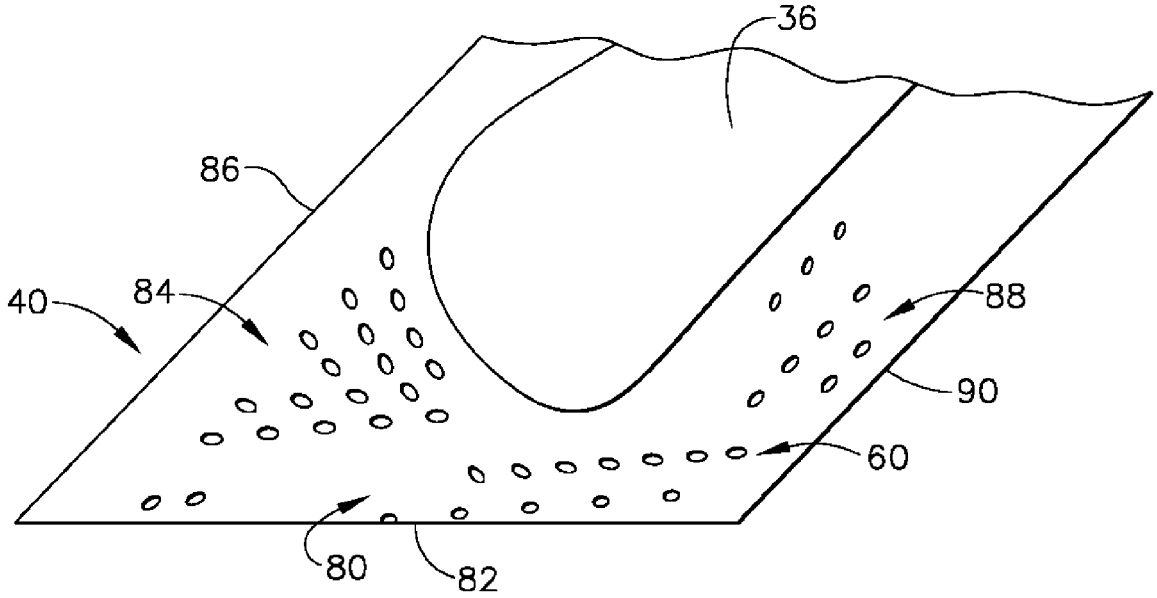
FIG.6 (PRIOR ART)
Figure 7:
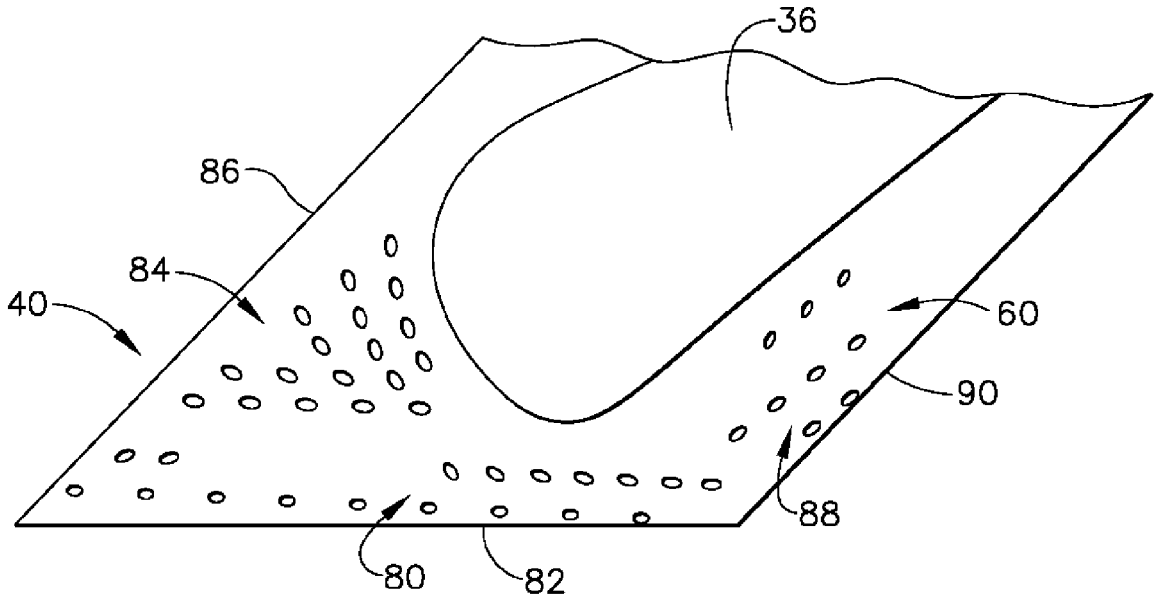
FIG.7 (PRIOR ART)

FIGS. 5-7 are top schematic views of a known inner band 40 that may be used with nozzle singlet 32. Specifically, FIGS. 5-7 illustrate an exemplary orientation of cooling holes 60 on inner band 40 around airfoil 36. Although FIGS. 5-7 depict cooling holes 60 in inner band 40, it should be understood that the configuration of cooling holes 60 of outer band 38 may be substantially identical to that of inner band 40, and as such, the following description will also apply to outer band 38. In the exemplary embodiment, cooling holes 60 are arranged in a pattern that includes a plurality of forward cooling holes 80 machined in a forward end 82 of inner band 40, a plurality of first side cooling holes 84 machined in a first circumferentially-spaced side 86 of inner band 40, and a plurality of second side cooling holes 88 machined in a second circumferentially-spaced side 90 of inner band 40.

As illustrated in FIGS. 5-7, the cooling holes 60 are illustrated after inner band 40 has been machined to be fit within nozzle assembly 24. Specifically, cooling holes 60 are machined into inner band 40 prior to orientating nozzle singlet 32 within nozzle assembly 24. Within known nozzle assemblies, the pattern of cooling holes 60 within the nozzle assembly is identical for each nozzle singlet 32 being fabricated. To adjust airfoil angle $\alpha_1$, inner band 40 is machined prior to being installed within nozzle assembly 24. Specifically, to make adjustments to airfoil angle $\alpha_1$, inner band 40 is reshaped to facilitate fitting a plurality of adjacent nozzle singlets 32 within nozzle assembly 24.

FIG. 5 illustrates an original inner band 40, wherein the airfoil angle $\alpha_1$ has not been adjusted. Because airfoil angle $\alpha_1$ has not been adjusted, all of cooling holes 60, illustrated in FIG. 5, have remained intact within inner band 40. In contrast, FIG. 6 illustrates a reshaped inner band 40, wherein airfoil angle $\alpha_1$ has been increased to provide a greater throat area $A_1$. Notably, several of forward cooling holes 80 have been removed from inner band 40. Moreover, FIG. 7 illustrates a reshaped inner band 40, wherein airfoil angle $\alpha_1$ has been decreased to decrease throat area $A_1$. Notably, several of forward cooling holes 80 have been removed from inner band 40.

As illustrated by FIGS. 5-7, an adjustment in airfoil angle $\alpha_1$ may result in a need to change the pattern of cooling holes 60 throughout inner band 40. As such, the production of nozzle singlets 32 becomes more costly and labor intensive.

Figure 8:
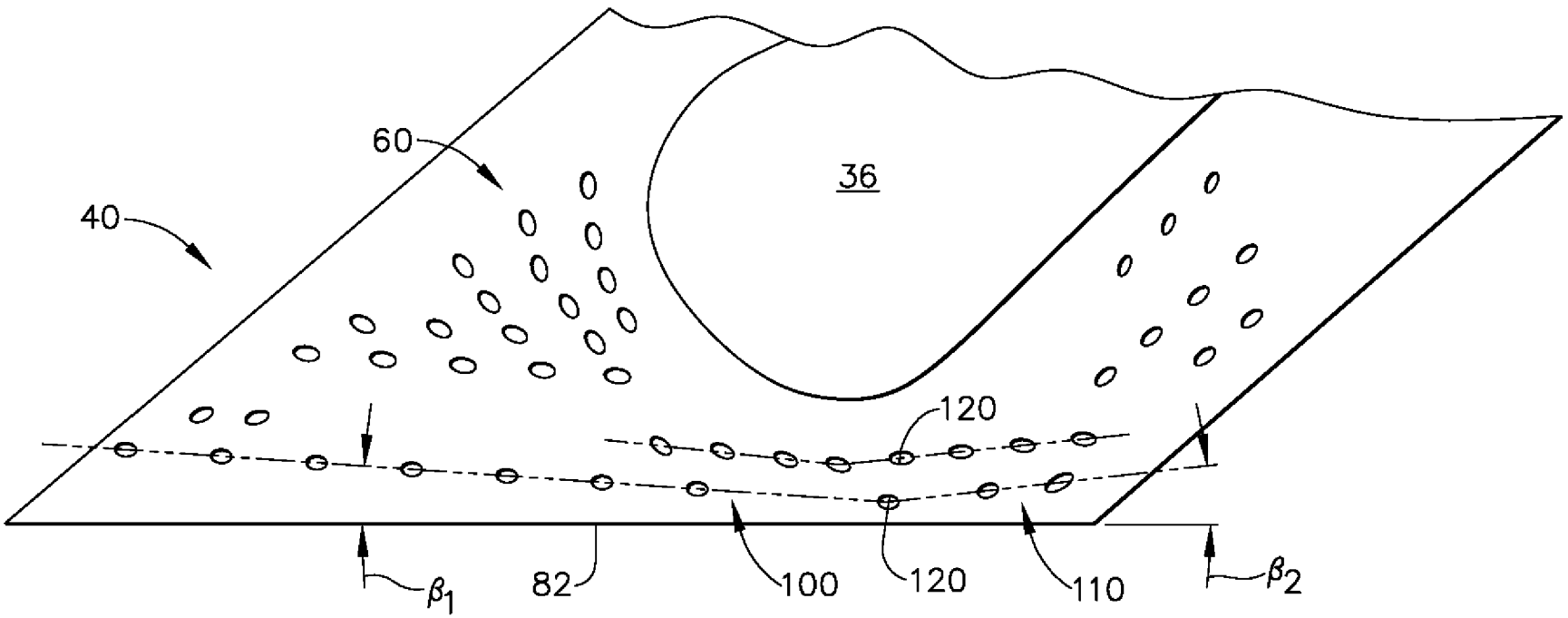
FIG. 8 is a top schematic view of an exemplary inner band that may be used with the nozzle singlet shown in FIG. 3.

FIG. 8 is a top schematic view of an exemplary inner band 40 that may be used with nozzle singlet 32. Specifically, within inner band 40, cooling holes 60 are oriented around airfoil 36 in a V-shaped pattern. Although FIG. 8 depicts cooling holes 60 in inner band 40, it should be understood that the orientation of cooling holes 60 within outer band 38 may be substantially identical to that of inner band 40. As such, the following description will also apply to outer band 38. In the exemplary embodiment, cooling holes 60 are oriented in a pattern wherein inner band 40 includes two first rows 100 of cooling holes 60 oriented in forward end 82 of inner band 40. In an alternative embodiment, the first rows 100 of cooling holes 60 are oriented at any suitable location of inner band 40 that enables cooling holes 60 to function as described herein. In another alternative embodiment, inner band 40 includes any suitable number of first rows 100 that facilitates cooling of nozzle singlet 32 as described herein. Moreover, first rows 100 may include any number of cooling holes 60 that facilitates cooling of nozzle singlet 32 as described herein. In the exemplary embodiment, first rows 100 are oriented at an oblique angle $\beta_1$ with respect to forward end 82. In another embodiment, wherein first rows 100 are positioned at a different location of inner band 40, first rows 100 are oriented at any angle with respect to any end of inner band 40 that facilitates cooling nozzle singlet 32 as described herein.

In the exemplary embodiment, inner band 40 also includes two second rows 110 of cooling holes 60 positioned in forward end 82 of inner band 40. In an alternative embodiment, the second rows 110 of cooling holes 60 are positioned at any suitable location of inner band 40 that facilitates cooling of nozzle singlet 32 as described herein. In an alternative embodiment, inner band 40 includes any suitable number of second rows 110 that facilitates cooling of nozzle singlet 32 as described herein. Further, second rows 110 may include any number of cooling holes 60 that facilitates cooling of nozzle singlet 32 as described herein. In the exemplary embodiment, second rows 110 are oriented at an oblique angle $\beta_2$ with respect to forward end 82. In another embodiment, wherein second rows 110 are positioned at a different location of inner band 40, second rows 110 are oriented at any angle with respect to any end of inner band 40 that facilitates cooling of nozzle singlet 32 as described herein.

Angles $\beta_1$ and $\beta_2$ are any angles that facilitate inner band 40 being machined, after airfoil 36 is rotated, without removing any cooling holes 60 defined within first rows 100 or second rows 110. Specifically, airfoil 36 is oriented, prior to assembly of nozzle assembly 24, to provide a desired throat width $W_1$ within nozzle assembly 24. After airfoil 36 is oriented to a desired angle, the edges, including forward end 82, of inner band 40 may be machined, without removing cooling holes 60, such that each nozzle singlet 32 can be positioned substantially flush against circumferentially-adjacent nozzle singlets 32 to provide a substantially uniform circumferential nozzle assembly 24. As such, the location an orientation of the first and second rows of cooling holes 100 and 110 enables machining of nozzle singlet 32 without having to redesign the pattern of cooling holes 60, such that a desired throat area $A_1$ can be defined between airfoils 36.

In the exemplary embodiment, cooling hole first rows 100 and cooling hole second rows 110 are oriented such that each of first row 100 shares a cooling hole 120 with one of second rows 110. In an alternative embodiment, any number of first rows 100 may share a cooling hole 60 with one of second rows 110. Further, in another embodiment, none of first rows 100 share a cooling hole 60 with any of second rows 110. Moreover, in the exemplary embodiment, one of first rows 100 has a larger number of cooling holes 60 than one of second rows 110. In an alternative embodiment, first rows 100 and/or second rows 110 are formed with any suitable number of cooling holes 60 that facilitates cooling of nozzle singlet 32 as described herein.

In the exemplary embodiment, two parallel first rows 100 of cooling holes are illustrated. In another embodiment, inner band 40 includes more than two parallel first rows 100. In an alternative embodiment, first rows 100 are not parallel, but rather, each is oriented at a different angle $\beta_1$. Moreover, in the exemplary embodiment, two parallel second rows 110 of cooling holes are illustrated. In another embodiment, inner band 40 includes more than two parallel second rows 110. In an alternative embodiment, second rows 110 are not parallel, but rather, each is oriented at a different angle $\beta_2$.

The above-described method and apparatus facilitate producing nozzle singlets that include an airfoil that may be oriented to provide any desired throat area between adjacent singlets. Specifically, the orientation of the cooling holes on the nozzle singlet inner and outer bands enables the airfoil to be rotated and inner and outer bands to be machined without having to redesign and redrill the cooling hole pattern. Specifically, the airfoil can be angled, prior to assembly of the nozzle assembly, to provide a desired area within the nozzle assembly. After the airfoil is angled, the edges of inner band can be machined without removing any cooling holes. As such, the orientation of the first and second rows of cooling holes provides a single cooling hole pattern that does not required redesigning and/or redrilling to accommodate a change in the airfoil angle.

In one embodiment, a method for orienting cooling holes of a nozzle singlet for a turbine engine is provided. The method includes providing a nozzle singlet having an inner band, an outer band, and at least one airfoil extending therebetween. The method also includes orienting at least one first row of cooling holes an angle with respect to at least one second row of cooling holes. The orientation of the at least one first row and the at least one second row provides a cooling hole pattern that accommodates a change in the airfoil angle without reorienting the cooling hole pattern.

As used herein, an element or step recited in the singular and proceeded with the word "a" or "an" should be understood as not excluding plural said elements or steps, unless such exclusion is explicitly recited. Furthermore, references to "one embodiment" of the present invention are not intended to be interpreted as excluding the existence of additional embodiments that also incorporate the recited features.

Although the apparatus and methods described herein are described in the context of a nozzle singlet for a gas turbine engine, it is understood that the apparatus and methods are not limited to gas turbine engines or nozzle singlets. Likewise, the gas turbine engine and the nozzle singlet components illustrated are not limited to the specific embodiments described herein, but rather, components of both the gas turbine engine and the nozzle singlet can be utilized independently and separately from other components described herein.

While the invention has been described in terms of various specific embodiments, those skilled in the art will recognize that the invention can be practiced with modification within the spirit and scope of the claims.

What is claimed is:

1. A method for orienting cooling holes of a nozzle singlet for a turbine engine, said method comprising:

providing a nozzle singlet having an inner band that includes an inner band leading edge, an outer band that includes an outer band leading edge, and an airfoil extending between the inner band and the outer band, the airfoil including an airfoil leading edge;

forming at least one first row of the cooling holes at an angle with respect to at least one second row of the cooling holes about the airfoil leading edge and along at least one of the inner band leading edge and the outer band leading edge, wherein an orientation of the at least one first row and the at least one second row provides a cooling hole pattern that accommodates a change in an orientation of the airfoil without reorienting the cooling hole pattern.

2. A method in accordance with claim 1 further comprising forming the at least one first row of the cooling holes to share at least one cooling hole with the at least one second row of the cooling holes.

3. A method in accordance with claim 1 further comprising forming the at least one first row of the cooling holes to have a greater number of cooling holes than the at least one second row of the cooling holes.

4. A method in accordance with claim 1 further comprising orienting a plurality of the at least one first row of the cooling holes to be substantially parallel.

5. A method in accordance with claim 1 further comprising orienting a plurality of the at least one second row of the cooling holes to be substantially parallel.

6. A method in accordance with claim 1 further comprising orienting the at least one first row of the cooling holes and the at least one second row of the cooling holes to enable the nozzle singlet to be machined to facilitate defining a desired throat area between circumferentially-adjacent nozzle singlets.

7. A method in accordance with claim 1 further comprising orienting the at least one first row of the cooling holes and the at least one second row of the cooling holes to enable the nozzle singlet to be machined to facilitate providing a desired mass flow of gas between circumferentially-adjacent nozzle singlets.

8. A nozzle singlet for a turbine engine, said nozzle singlet comprising:

an inner band that comprises an inner band leading edge, an outer band that comprises an outer band leading edge, and an airfoil extending between said inner band and said outer band, said airfoil comprising an airfoil leading edge; and at least one first row of cooling holes oriented at an angle with respect to at least one second row of cooling holes about said airfoil leading edge and along at least one of said inner band leading edge and said outer band leading edge, wherein an orientation of said at least one first row and said at least one second row provides a cooling hole pattern that accommodates a change in an orientation of said airfoil without reorienting the cooling hole pattern.

9. A nozzle singlet in accordance with claim 8 wherein said at least one first row of cooling holes shares a cooling hole with said at least one second row of cooling holes.

10. A nozzle singlet in accordance with claim 8 wherein at least one of said at least one first row of cooling holes includes a greater number of cooling holes than said at least one of said second row of cooling holes.

11. A nozzle singlet in accordance with claim 8 further comprising a plurality of said at least one first row of cooling holes that are substantially parallel.

12. A nozzle singlet in accordance with claim 8 further comprising a plurality of said at least one second row of cooling holes that are substantially parallel.

13. A nozzle singlet in accordance with claim 8 wherein said at least one first row of cooling holes and said at least one second row of cooling holes are oriented to enable said nozzle singlet to be machined to facilitate defining a desired throat area between circumferentially-adjacent nozzle singlets.

14. A nozzle singlet in accordance with claim 8 wherein said at least one first row of cooling holes and said at least one second row of cooling holes are oriented to enable said nozzle singlet to be machined to facilitate providing a desired mass flow of gas between circumferentially-adjacent nozzle singlets.

15. A turbine engine comprising a turbine nozzle assembly comprising a plurality of nozzle singlets, wherein each of said nozzle singlets comprises:

an inner band that comprises an inner band leading edge, an outer band that comprises an outer band leading edge, and an airfoil extending between said inner band and said outer band, said airfoil comprising an airfoil leading edge; and at least one first row of cooling holes oriented at an angle with respect to at least one second row of cooling holes about said airfoil leading edge and along at least one of said inner band leading edge and said outer band leading edge, wherein an orientation of said at least one first row and said at least one second row provides a cooling hole pattern that accommodates a change in an orientation of said airfoil without reorienting the cooling hole pattern.

16. A turbine engine in accordance with claim 15 wherein said at least one first row of cooling holes shares a cooling hole with said at least one second row of cooling holes.

17. A turbine engine in accordance with claim 15 wherein said at least one first row of cooling holes includes a greater number of cooling holes than said at least one second row of cooling holes.

18. A turbine engine in accordance with claim 15 further comprising a plurality of said at least one first row of cooling holes that are substantially parallel.

19. A turbine engine in accordance with claim 15 further comprising a plurality of said at least one second row of cooling holes that are substantially parallel.

20. A turbine engine in accordance with claim 15 wherein said at least one first row of cooling holes and said at least one second row of cooling holes are oriented to enable said nozzle singlet to be machined to facilitate providing at least one of a desired throat area and a desired mass flow of gas between circumferentially-adjacent nozzle singlets.

* * * * *